United States Patent [19]

Schoppelrey

[11] 4,099,824

[45] Jul. 11, 1978

[54] MECHANICALLY ADJUSTABLE ELECTRIC OUTLET DEVICE

[76] Inventor: Victor H. Schoppelrey, 1202 N. Harding, St. Orange, Calif. 92667

[21] Appl. No.: 802,970

[22] Filed: Jun. 3, 1977

[51] Int. Cl.[2] ..... F21P 1/02

[52] U.S. Cl. ..... 339/157 C; 362/123

[58] Field of Search ..... 240/10 T; 339/119, 157 R, 339/157 C, 21 R; 362/123, 806

[56] References Cited

U.S. PATENT DOCUMENTS

| | | | |
|---|---|---|---|
| 1,974,472 | 9/1934 | Seghers | 339/157 C |
| 2,468,773 | 5/1949 | Musinski | 339/157 C |
| 2,474,356 | 6/1949 | Harris | 339/157 C |
| 3,096,943 | 7/1963 | Forrer | 339/157 C |
| 3,770,951 | 11/1973 | Corelli | 240/10 T |

*Primary Examiner*—Roy Lake
*Assistant Examiner*—E. F. Desmond
*Attorney, Agent, or Firm*—Harold C. Horwitz

[57] ABSTRACT

The mechanically adjustable electric outlet device comprises a plurality of female receptacle plugs connected in parallel circuit and a semi-stiff, spring-metal wire which is resiliently formed into a circle of variable diameter so as to mount at the top of Christmas trees of various diameter trunks. One end of the electric outlet device terminates in a conventional male plug which energizes the device by connecting to a power source while the other end of the device terminates in a fastener part which may fasten to second fastener means of any of the female receptacle plugs to provide circular mounting around Christmas tree trunks of various diameters.

1 Claim, 5 Drawing Figures

MECHANICALLY ADJUSTABLE ELECTRIC OUTLET DEVICE

BACKGROUND OF THE INVENTION

1. Field of the Invention

This invention relates to electric outlet devices and particularly to a mechanically adjustable electric outlet device capable of circular mounting on Christmas trees of various diameters. The advantage of the resilient construction of the electric plug adaptor device is that it can be shipped in its linear form and is also circularly and resiliently adaptable to mount on Christmas trees of various diameters.

2. Description of the Prior Art

The prior art discloses Christmas tree ornament and decoration devices wherein the device comprises a plurality of electric light bulbs provided in a cluster on a body member. This art is limited by a small number of retractably mounted bulbs and is complex and expensive to manufacture.

Additional prior art discloses a plurality of strings of miniature lamps permanently joined in parallel circuit. This device is unwieldy to handle, is complex, expensive to manufacture and lacks versatility in decor.

SUMMARY OF THE INVENTION

The preferred embodiment of this invention includes a number of conventional female electric receptacle plugs electrically connected in parallel and encased in insulative material. Also encased in the insulative material is a semi-stiff, spring-metal wire which provides resilient deformation to circular form of variable diameter. The spring-metal wire is located generally above the female receptacle plugs and is of the same approximate length as the string of female receptacle plugs. The hooked end of the electric outlet device is one fastening means which may be placed around any of the second fastening means on the female plug bases. The bases provide a second fastening means comprising concave sides to frictionally engage first fastening means. The second end of the electric outlet device connects to a power source. Strings of light, either connected in parallel or series, are connected to the various electric outlets of the device at the top of the tree. Additional electric outlet devices may be mounted on larger trees at different locations along the tree trunk to provide means for greater coverage with many strings of lights. The additional electric outlet devices may be energized by connecting them to the first device.

An object of the invention, therefore, is to provide an electrical outlet device mechanically adjustable, capable of resilient, circular embracement of Christmas trees of various diameter trunks.

A further object of this invention is to provide multiple energy sources for strings of Christmas tree lights so that an inordinately long string need not be helically wrapped around the tree.

Another object of the invention is to overcome multiple connections from many Christmas tree light strings to the home electrical outlet.

The invention also provides as its object, ease and simplicity of manufacture and versatility of placement of Christmas tree light strings.

DESCRIPTION OF THE PREFERRED EMBODIMENTS

The preferred embodiment is described with reference to an electric outlet device, adaptable to resilient, circular embracement of Christmas tree trunks of various diameters.

Figure 1:
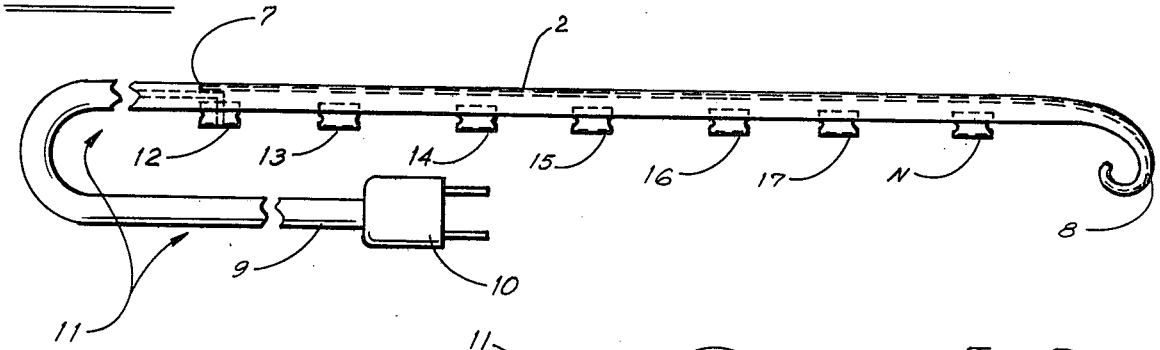
FIG. 1 is a section view of the electric outlet.

Referring to FIG. 1, the electric outlet device 11 is shown, in section, to comprise a plurality of female receptacle plugs 12, 13, 14, 15, 16, 17, N of conventional electrical construction. A spring-metal wire 2 terminates at fastener end 8 and at end 7 located generally above socket 12. The electric outlet device is energized by connecting plug 10 at second end 9 of the device to the home outlet.

Figure 2:
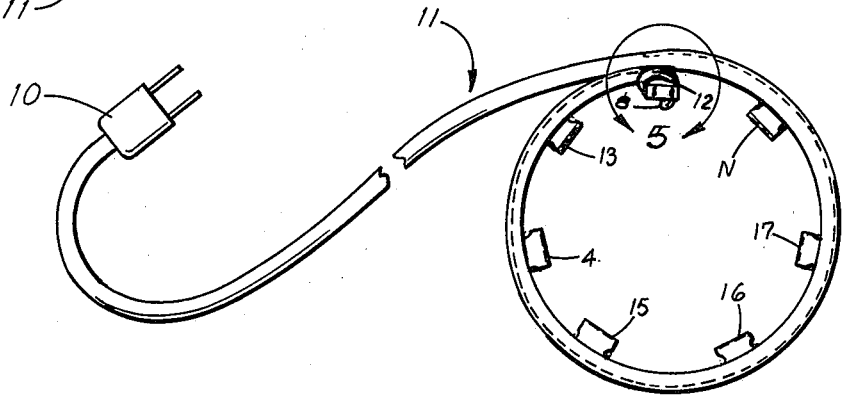
FIG. 2 is an angular view of the device shown with first and second fastening means interengaged.

FIG. 2 depicts the electric outlet device extended to its maximum diameter, obtained by engaging fastener 8 around fastening means of base 6 of socket 12. Each base 6 has fastening means shown in detail in FIG. 5. A minimum diameter is obviously obtained by engaging fastening means 8 around base 6 fastening means of socket N, closest to fastening means 8 and intermediate diameter trees may be accommodated by engaging fastening means 8 around base 6 fastening means of sockets 13, 14, 15, 16 or 17.

Figure 3:
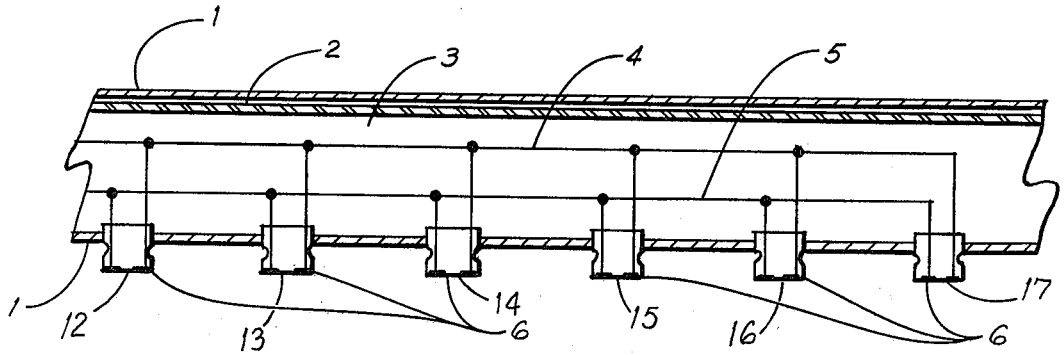
FIG. 3 is a detailed sectional view depicting spring-metal wire and parallel interconnections of female receptacle plugs.

FIG. 3 is an exploded, section view of the electric outlet device 11 and discloses the insulative housing 1, the spring-metal wire 2 along the length of the device from fastening means 8 to a point located generally above socket 12. The electric outlet device may be made from any conventional, insulating material 1, 3. The female receptacle plugs are connected in parallel by wires 4, 5 and are of conventional electric construction.

Figure 4:
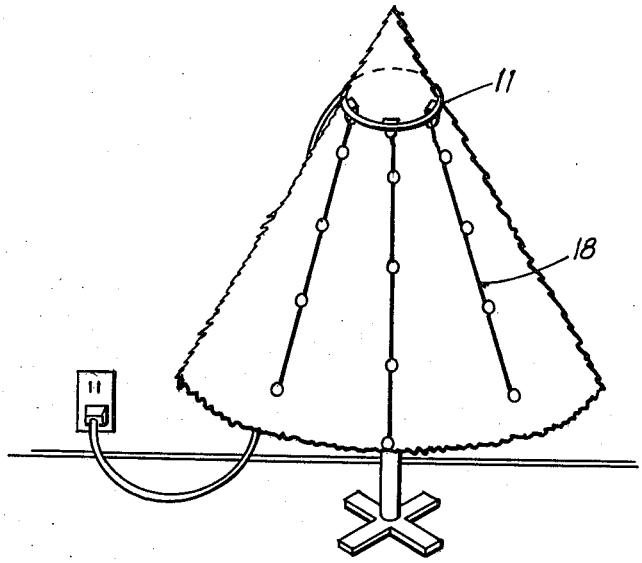
FIG. 4 depicts the electric outlet device mounted on a Christmas tree and light strings attached thereto.

FIG. 4 discloses the electric light plug adaptor device 11 connected to the top portion of a Christmas tree. Conventional strings of lights 18 connect to the adaptor for electrification.

Figure 5:
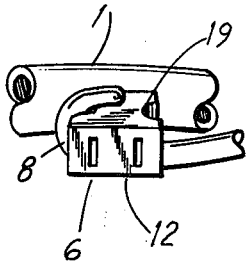
FIG. 5 is an expanded view of the first and second fastening means interengaged.

FIG. 5 is an expanded view depicting device fastening means 8 interengaged with second fastening means 19 of electric receptacle 12. Second fastening means comprises concave indentation 19 of base 6 of receptacle 12.

Although I have described but one preferred embodiment of my invention, it is to be understood that various changes and revisions can be made therein without departing from the spirit of the invention as expressed in the appended claims.

I claim:

1. A multiple electrical outlet device which is mechanically adjustable, comprising:

an elongated housing made of insulating material;

a pair of electric circuit wires disposed in spaced relation within said housing;

a plurality of contact pairs spaced along the length of said housing, the contacts in each of said pairs extending into the interior of said housing and being connected to corresponding ones of said circuit wires, said housing having openings through which said contacts are accessible from the exterior of said housing, whereby each of said circuit pairs provides a separate electrical receptacle;

an elongated metal spring member disposed within said housing and insulated from said circuit wires, said spring member extending substantially the full distance between the two most remote ones of said receptacles;

means associated with one end of said housing for selectively energizing said circuit wires;

a first fastener part carried by the other end of said housing;

at least two of said receptacles adjacent said one end of said housing being of such configuration as to form a second fastener part, said first and second fastener parts being adapted for selective interengagement; and said housing and said metal spring member cooperatively providing a resiliently deformable action such that said housing may be bent into a substantially circular configuration with said other end thereof being positioned in the vicinity of said one end thereof, in order to interengage said first and second fastener parts together;

whereby said device may be selectively formed into a circular configuration of desired diameter, and when usage thereof has been completed, may then be returned to its original essentially straight configuration.

* * * * *